United States Patent [19]

David et al.

[11] 3,952,164

[45] Apr. 20, 1976

[54] VOCODER SYSTEM USING DELTA MODULATION

[75] Inventors: Guy Albert Jules David, Thiais; Gilbert Marie Marcel Ferrieu, Bievres (Essonne); Pierre Lorand; Michel Cartier, both of Lannion, all of France

[73] Assignees: Telecommunications Radioelectriques et Telephoniques T.R.T.; Etat Francais, both of Paris, France

[22] Filed: July 18, 1974

[21] Appl. No.: 489,577

[30] Foreign Application Priority Data

July 20, 1973 France ..... 73.26733

[52] U.S. Cl. ..... 179/15.55 R; 179/1 SA

[51] Int. Cl.[2] ..... G10L 1/00

[58] Field of Search ..... 179/1 SA, 15.55 R

[56] References Cited

UNITED STATES PATENTS

| | | | |
|---|---|---|---|
| 3,030,450 | 4/1962 | Shroeder | 179/15.55 R |
| 3,750,024 | 7/1973 | Dunn et al. | 179/1 SA |

*Primary Examiner*—Kathleen H. Claffy
*Assistant Examiner*—E. S. Kemeny
*Attorney, Agent, or Firm*—Frank R. Trifari; Henry I. Steckler

[57] ABSTRACT

A speech transmission system employing a semi-vocoder comprising a spectral analyzer and a spectral synthesizer for the upper frequency range of the speech signal. The speech signal in the low frequency range base band is transmitted by using delta modulation and the delta-modulated base band signal is used directly in the receiver as a voice excitation signal for the spectral synthesizer.

3 Claims, 2 Drawing Figures

VOCODER SYSTEM USING DELTA MODULATION

The invention relates to a vocoder system for transmitting a voice signal from a transmitter to a receiver, said transmitter comprising means for deriving from said voice signal a base band signal representative of components in a lower frequency range of said voice signal, a spectral analyzer for deriving from said voice signal narrow band control signals representative of the energy distribution of individual components in an upper frequency range of said voice signal, and means for transmitting said base band signal and said control signals to said receiver, said receiver comprising a spectral synthesizer controlled by said control signals for selectively employing a voice excitation signal derived from said base band signal to generate artificial signals representative of said individual components in said upper frequency range, and means for combining said artificial signals with said base band signal to produce a reconstruction of said voice signal.

The systems for speech analysis and synthesis conventionally referred to as "vocoders" are used especially for the analog or digital transmission of the speech signal in a narrow frequency band or with a low bit rate. A description of the different known techniques used for the construction of vocoders can be found in an article by M. R. Schroeder entitled "Vocoders: Analysis and Synthesis of Speech" in "Proceedings of the I.E.E.E." Volume 54, No. 5, May 1966, pages 720–733.

In a conventional channel vocoder the spectral analyzer operates on the overal frequency band of the speech signal (for example 200 – 3400 Hz) for providing signals corresponding to the energies of the speech signal components in relatively narrow continguous frequency bands (100 Hz to 400 Hz), while a device referred to as "fundamental analyzer" detects whether a particular sound is voiced or unvoiced and provides information representative of the fundamental or pitch frequency of the voice. In the spectral synthesizer the speech signal is reconstructed with the aid of the signals originating from the spectral analyzer and an excitation signal derived from the signal originating from the fundamental analyzer. the transmission of the signals from the analyzer to the synthesizer may be effected by known analog or digital processes. For obtaining a satisfactory reproduction quality in such a vocoder one of the difficulties resides in the fundamental frequency detector and in the device forming the excitation signal.

In a "semi-vocoder" system, which is described below and which the invention envisages to perfect, a relatively large lower frequency range of the speech signal (base band extending from 200 to 1050 Hz) is transmitted directly to the synthesizer, while the upper frequency range (1050 to 3400 Hz) is transmitted with the aid of a spectral analyzer in accordance with the method used in conventional channel vocoders. In the synthesizing part, the semi-vocoder comprises a spectral synthesizer only utilized for reconstructing the upper frequency range of the speech signal, but in the semi-vocoder the excitation signal is derived from the speech signal in the base band. With regard to the conventional channel vocoder, the difficulty of the "fundamental frequency detector" has been overcome in the semi-vocoder, but the difficulty of forming the excitation signal remains. In the known semi-vocoders (see the aforementioned Article by Schroeder on page 730, FIG. 13, and also U.S. pat. spec. No. 3,030,450) the excitation signal is generated by a device referred to as "spectrum flattener" which spreads out the spectrum of the base band signal to cover the upper frequency range of the speech signal and which equalizes the components thus formed to obtain a flat-spectrum excitation signal. Such an arrangement is relatively complicated and expensive in its realization.

It is the object of the present invention to provide a very simple means for obtaining the excitation signal in a vocoder system of the type set forth in the preamble.

The vocoder system according to the invention, is characterized in that said system comprises a delta modulator for deriving from said base band signal a voice excitation signal.

The invention is particularly advantageous for a vocoder system in which the signals are transmitted by digital processes. In this case the transmitter comprises a delta modulator for producing a digital signal representative of said base-band signal and means for transmitting said digital signal to the receiver, while the receiver comprises a delta demodulator responsive to said transmitted digital signal for producing a reconstruction of said base band signal and means for directly supplying said transmitted digital signal as a voice excitation signal to said spectral synthesizer. By using delta modulation for the digital transmission of the base band signal the generator for the excitation signal used in the semi-vocoders of the prior art is completely economized.

The following description with reference to the accompanying drawings, all given by way of non-limiting example, will make it better understood how the invention can be carried into effect.

Figure 1:
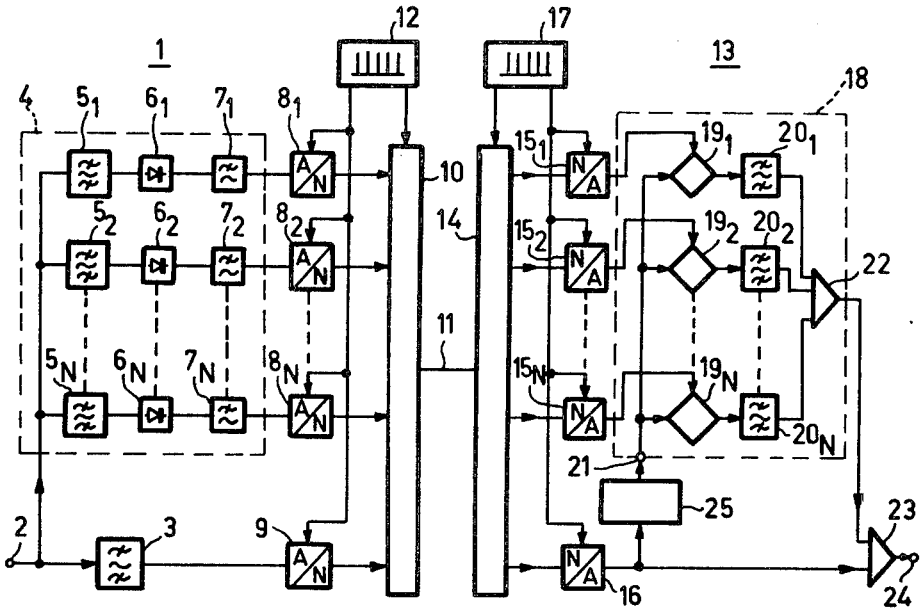
FIG. 1 shows the embodiment of a semi-vocoder of the prior art.

The semi-vocoder of the prior art according to FIG. 1 and the semi-vocoder according to the invention shown in FIG. 2 comprise a number of common elements to be described hereinafter. In both cases it is assumed that the transmission of the signals is effected by digital processes. In an analyzing part 1 situated on the left-hand side in these Figures, the speech signal is applied to an input terminal 2. Furthermore it is assumed that the frequency band of this speech signal is the telephony band extending from 200 to 3400 Hz. The speech signal is applied to a bandpass filter 3 which passes the frequencies in a lower frequency range referred to as base band and which extends, for example, from 200 to 1050 Hz. The speech signal is also applied in a spectral analyzer 4 to a number N of bandpass filters $\mathbf{5}_1$ to $\mathbf{5}_N$ having contiguous passbands with bandwidths between 100 and 400 Hz and jointly covering the upper frequency range (1050 to 3400 Hz) of the speech signal. A number N of detectors $\mathbf{6}_1$ to $\mathbf{6}_N$ which are connected to the outputs of these filters $\mathbf{5}_1$ to $\mathbf{5}_N$, provide control signals representative of the energy of the speech signal in the N channels formed by these filters. According to the nature of the speech signal these control signals vary relatively slowly and are applied to N lowpass filters $\mathbf{7}_1$ to $\mathbf{7}_N$ having a narrow bandwidth of the order of 20 Hz. The set of N control signals at the outputs of these lowpass filters $\mathbf{7}_1$ to $\mathbf{7}_N$ represent the envelope of the spectrum of the speech signal in the upper frequency range.

To effect a digital transmission of the signals provided by the analyzing part 1 of the semi-vocoder to its synthesizing part 13, the N control signals provided by spectral analyzer 4 are sampled and coded in N analog-to-digital converters $8_1$ to $8_N$ and the base band signal provided by bandpass filter 3 is sampled and coded in an analog-to-digital converter 9.

The N + 1 digital output signals from these converters $8_1 - 8_N$, 9 are multiplexed in a time-division-multiplexer 10 so as to be transmitted through a transmission channel 11 to the synthesizing part 13 of the semi-vocoder. A clock pulse generator 12 provides the basic frequencies required to operate the converters and the multiplexer.

The N + 1 digital signals applied to multiplexer 10 are recovered at the N + 1 outputs of a time-division-demultiplexer 14 connected to the output of the transmission channel 11. A number N of digital-to-analog converters $15_1$ to $15_N$ are connected to N outputs of demultiplexer 14, which converters restore the N control signals obtained at the output of spectral analyzer 4. A digital-to-analog converter 16 is connected to the remaining output of demultiplexer 14, which converter restores the base band signal obtained at the output of filter 3. A clock pulse generator 17 synchronized by known means with clock pulse generator 12 of the analyzer part provides the basic frequencies required to operate the converters and the demultiplexer.

The N analog signals corresponding to the control signals provided by spectral analyzer 4 are applied to a spectral synthesizer 18 for the upper frequency range of the speech signal. This synthesizer 18 comprises N amplitude modulators $19_1$ to $19_N$ and the said N control signals are applied to their control input. The other input of these modulators is connected to a terminal 21 to which a voice excitation signal is applied which must be derived from the base band signal and which must have a flat spectrum in the upper frequency range of the speech signal. This voice excitation signal is obtained in different manners described hereinafter for the known semi-vocoder of FIG. 1 and for the semi-vocoder according to the invention of FIG. 2. The output of modulators $19_1$ to $19_N$ is connected to bandpass filters $20_1$ to $20_N$ having the same transfer characteristics as filters $5_1$ to $5_N$ of analyzer part 1. Assuming that the voice excitation signal has the characteristics defined above, FIGS. 1 and 2 show that the spectral components of equal amplitude of this voice excitation signal are amplitude-modulated in modulators $19_1$ to $19_N$ by the set of N control signals of the input of synthesizer 18 representing the envelope of the spectrum of the upper frequency range of the speech signal, and are subsequently separated in N contiguous bands by bandpass filters $20_1$ to $20_N$. The output signals of filters $20_1$ to $20_N$ are applied to a summing amplifier 22 which supplies the speech signal in the upper frequency range. The latter signal and the base band signal supplied by digital-to-analog converter 16 are applied to a summing amplifier 23 which supplies the reconstructed speech signal in the desired complete frequency band to an output 24 of the semi-vocoder.

Instead of connecting bandpass filters $20_1$ to $20_N$ to the output of modulators $19_1$ to $19_N$ it is alternatively possible to connect these filters to the input of the modulators and the voice excitation signal is then separated by these filters in N contiguous bands before modulation. The signals applied to summing amplifier 22 are the same as those mentioned hereinbefore.

In the known semi-vocoders the voice excitation signal is provided, as shown in FIG. 1, by an excitation signal generator 25 whose input receives the base-band speech signal in an analog form obtained from the output of converter 16. This excitation generator 25 performs two functions: first, the spectrum of the base band signal, extending in the example chosen from 200 to 1050 Hz, is spread out, by non-linear distortion, to cover the upper frequency range from 1050 to 3400 Hz; then the frequency components generated by non-linear distortion are equalized to form a flat-spectrum excitation signal. The aforementioned article by Schroeder and U.S. pat. spec. No. 3,030,450 show different methods of realizing this generator, which methods are relatively complicated.

Figure 2:
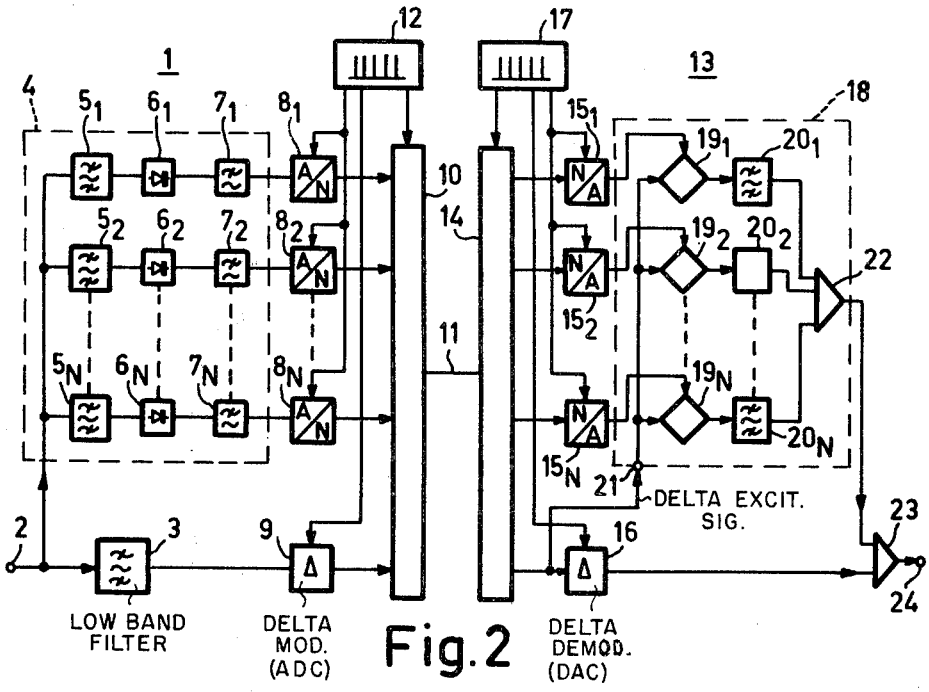
FIG. 2 shows the embodiment of the semi-vocoder according to the invention.

In the semi-vocoder according to the invention, shown in FIG. 2, the voice excitation signal is obtained without using a special excitation generator. For that purpose, the analog-to-digital converter 9 in the transmission channel for the base band signal is realized as a delta modulator and the associated digital-to-analog converter 16 is realized as a delta demodulator. The delta-modulated base band signal received at the synthesizing part 13 is now applied to the terminal 21 so as to be used directly as a voice excitation signal in the spectral synthesizer 18. The delta-modulated base band signal indeed has a flat spectrum amply covering the upper frequency range of the speech signal band, which spectrum thus corresponds to that required for the voice excitation signal. Consequently, the voice excitation signal is obtained "gratis" by imposing a digital transmission by means of delta modulation on the base band signal transmission.

The digital transmission of the N control signals at the output of the spectral analyzer 4 may be effected by using PCM or delta modulation. When, for example, the spectral analyzer 4 comprises 7 channels and when PCM-modulation is used for the transmission of signals in these channels with a sampling frequency of 50 Hz and 4 bits per sample, the transmission of the control signals corresponding to the upper frequency range of the speech signal requires a bit rate of $50 \times 7 \times 4 = 1400$ bits per second. When a sampling frequency of 8 kHz is used in the delta modulator 9, the base band signal transmission requires a bit rate of 8000 bits per second. Taking account of a bit rate of 200 bits per second in an auxiliary channel (not shown) used for the transmission of a frame code permitting of multiplex synchronization, the complete speech signal is transmitted with a total bit rate of 9600 bits per second.

The most advantageous case of utilizing a semi-vocoder has so far been considered, in which the transmission from the analyzing part to the synthesizing part is effected by digital processes. It is alternatively possible to transmit directly, without digital coding, all analog signals provided by the analyzing part by using frequency-division-multiplex techniques. The synthesizing part of the semi-vocoder according to the invention then comprises a delta modulator to whose input the transmitted base band signal is applied and whose output signal is directly supplied as a voice excitation signal to the spectral synthesizer.

What is claimed is:

1. A vocoder system for transmitting a voice signal from a transmitter to a receiver, said transmitter comprising means for deriving from said voice signal a base band signal representative of components in a lower frequency range of said voice signal, a spectral analyzer means for deriving from said voice signal narrow band control signals representative of the energy distribution of individual components in an upper frequency range of said voice signal, and means coupled to both of said deriving means for transmitting said base band signal and said control signals to said receiver, said receiver comprising means for receiving the transmitted signals, a spectral synthesizer means coupled to said receiving means and controlled by said control signals for selectively employing a voice excitation signal derived from said base band signal to generate artificial signals representative of said individual components in said upper frequency range, means coupled to said synthesizer for combining said artificial signals with said base band signal to produce a reconstruction of said voice signal, and wherein said system further comprises a delta modulator means coupled to receive said base band signal for deriving from said base band voice excitation signal.

2. A vocoder system as claimed in claim 1, wherein said delta modulator means for producing a digital signal representative of said base band signal is disposed in said transmitter coupled between said base band signal deriving means and said means for transmitting said receiver comprising a delta demodulator means coupled to said receiving means responsive to said transmitted digital signal for producing a reconstruction of said base band signal, and means for directly supplying said transmitted digital signal as a voice excitation signal to said spectral synthesizer.

3. A vocoder receiver comprising main means for receiving narrow band control signals representative of the energy distribution of individual components in an upper frequency range of a voice signal, a spectral synthesizer means coupled to said receiving means and having an input means for receiving a delta modulated voice excitation signals representative of components in a lower frequency range of said voice signal for selectively employing said voice excitation signal derived from said base band signal to generate artificial signals representative of said individual components in said upper frequency range, and means for combining said artificial signals with said base band signal to produce a reconstruction of said voice signal.

* * * * *

UNITED STATES PATENT OFFICE

CERTIFICATE OF CORRECTION

Patent No. 3,952,164 Dated April 20, 1976

Inventor(s) Guy Albert Jules David et al.

It is certified that error appears in the above-identified patent and that said Letters Patent are hereby corrected as shown below:

In the Title page the assignee should read

-- [73] Assignee: Telecommunications Radioelectriques Et Telephoniques and ETAT Francais, both of Paris, France --.

Column 1, line 45, ". the" should read -- . The --.

Claim 2, line 6, after "mitting" insert a comma.

Signed and Sealed this twenty-third Day of August 1977

[SEAL]

Attest:

RUTH C. MASON
Attesting Officer

C. MARSHALL DANN
Commissioner of Patents and Trademarks

UNITED STATES PATENT OFFICE

CERTIFICATE OF CORRECTION

Patent No. 3,952,164 Dated April 20, 1976

Inventor(s) Guy Albert Jules David et al.

It is certified that error appears in the above-identified patent and that said Letters Patent are hereby corrected as shown below:

On the cover sheet Item (73) Assignees should read:

-- Telecommunications Radioelectriques et Telephoniques T.R.T., of Pairs, France; Etat Francai, of Issy-Les-Moulineau, France ---.

Signed and Sealed this

*Fifteenth* Day of *November 1977*

[SEAL]

*Attest:*

RUTH C. MASON
*Attesting Officer*

LUTRELLE F. PARKER
*Acting Commissioner of Patents and Trademarks*